United States Patent [19]

Sweany et al.

[11] 4,156,156

[45] May 22, 1979

[54] METHOD FOR REDUCING THE RESONANT FREQUENCY OF A PIEZOELECTRIC TRANSDUCER

[75] Inventors: Louis P. Sweany, Carmel; Lyle E. Shoot, Indianapolis, both of Ind.

[73] Assignee: P. R. Mallory & Co. Inc., Indianapolis, Ind.

[21] Appl. No.: 825,599

[22] Filed: Aug. 18, 1977

[51] Int. Cl.[2] ..... H01R 41/10

[52] U.S. Cl. ..... 310/312; 29/25.35; 179/110 A; 310/324

[58] Field of Search ..... 310/321, 322, 324, 334, 310/312; 179/110 A, 110 C, 115 R, 115.5 ES, 138 R, 181 R; 29/25.35; 340/384 E, 388; 181/157, 158, 164, 173

[56] References Cited

U.S. PATENT DOCUMENTS

| | | | |
|---|---|---|---|
| 1,040,294 | 10/1912 | Ellis et al. | 181/164 X |
| 1,990,409 | 2/1935 | Lawrance | 181/164 |
| 1,997,790 | 4/1935 | Heidrich | 181/164 |
| 2,487,962 | 11/1949 | Arndt, Jr. | 179/110 A |
| 2,870,521 | 1/1959 | Rudnick | 29/25.35 |
| 3,815,129 | 6/1974 | Sweany | 310/324 X |
| 3,943,338 | 3/1976 | Massa | 310/324 X |

FOREIGN PATENT DOCUMENTS

| | | | |
|---|---|---|---|
| 667495 | 10/1938 | Fed. Rep. of Germany | 179/115.5 ES |

*Primary Examiner*—Mark O. Budd

*Attorney, Agent, or Firm*—Hoffmann, Meyer & Coles

[57] ABSTRACT

The resonant frequency of a conventional piezoelectric transducer having predetermined dimensions and a fundamental nodal diameter is reduced while maintaining the overall predetermined diameter and fundamental nodal diameter of the transducer. A method of reducing the resonant frequency of a conventional piezoelectric transducer includes the step of radially slotting the substrate of the transducer.

19 Claims, 4 Drawing Figures

METHOD FOR REDUCING THE RESONANT FREQUENCY OF A PIEZOELECTRIC TRANSDUCER

BACKGROUND OF THE INVENTION

1. Field of the Invention

The present invention generally relates to conventional piezoelectric transducers of the type which include a brass substrate having predetermined dimensions and a piezoelectric ceramic element having predetermined dimensions mechanically and electrically coupled to the brass substrate wherein the piezoelectric transducer has a fundamental resonant frequency and a fundamental nodal diameter. More specifically, the present invention relates to a method and means for reducing the resonant frequency of the piezoelectric transducer while maintaining the fundamental nodal diameter and substrate predetermined diameter.

Generally speaking, the novel method and means for reducing the resonant frequency of a cnventional piezoelectric transducer as described hereinabove includes the step of radially slotting the brass substrate of the transducer.

2. Description of the Prior Art

A piezoelectric transducer such as the one shown in FIGS. 1 and 2 has previously been used in audible alarm devices (See U.S. Pat. No. 3,815,129 assigned to P. R. Mallory & Co. Inc.) and has typically been operated at an audible frequency of about 3.0 KHZ which is substantially the fundamental resonant frequency of the transducer. In general, the prior art transducer includes a piezoelectric ceramic element mechanically and electrically coupled to a substrate, and at least two electrodes carried by the piezoelectric ceramic element. In order to attain an audible signal having a frequency of about 3.0 KHZ representing the fundamental resonant frequency of the transducer, the transducer will have certain predetermined dimensions, i.e., substrate diameter, substrate thickness, ceramic diameter, and ceramic thickness. Predicated upon these predetermined dimensions, the transducer will also have, in addition to a fundamental resonant frequency, a fundamental nodal diameter. Typically such transducers are mounted at at least one point on the circumference of a circle having a diameter substantially equal to the fundamental nodal diameter.

It has become desirable to reduce the fundamental resonant frequency of a conventional piezoelectric transducer as described hereinabove while maintaining the same fundamental nodal diameter and substrate diameter so that an audible alarm device having a lower audible frequency can be provided in the same packaging as the higher 3.0 KHZ audible alarm device. As known to those skilled in the art, the typical methods for reducing the fundamental resonant frequency of a free circular disk include increasing the diameter of the disk, changing the material composition of the disk, or reducing the thickness of the disk. However, to increase the substrate diameter of the above described transducer would result in a corresponding increase in the fundamental nodal diameter of the transducer, and materials which are as economic to use as the materials comprising the conventional 3.0 KHZ transducer do not provide any substantially significant advantages. Furthermore, the seemingly only other approach of reducing the thicknesses of the piezoelectric ceramic element and/or the substrate is not practical because of the limited ability to economically manufacture a piezoelectric ceramic element having a thickness significantly less than its predetermined thickness.

SUMMARY OF THE INVENTION

In accordance with the present invention in its broadest concept, there is provided a method and means for reducing the resonant frequency of a conventional piezoelectric transducer while maintaining the fundamental nodal diameter and the predetermined substrate (overall) diameter of the transducer.

It is therefore an object of the present invention to provide a method and means for reducing the fundamental resonant frequency of a conventional piezoelectric transducer while maintaining the fundamental nodal diameter and the predetermined substrate diameter of the transducer.

A further object of the present invention is to provide a method and means for reducing the fundamental resonant frequency of a conventional piezoelectric transducer to accomplish the objective described above which includes radially slotting the substrate of the transducer.

It is yet another object of the present invention to provide a method and means for reducing a fundamental resonant frequency of about 3.0 KHZ of a conventional piezoelectric transducer to a resonant frequency of substantially 2.0 KHZ while maintaining the fundamental nodal diameter and the predetermined substrate diameter of the transducer.

Still another object of the present invention is to provide a method and means for reducing the fundamental resonant frequency of a conventional piezoelectric transducer which accomplishes the objectives enumerated above without substantially increasing the impedance of the transducer.

Still yet another object of the present invention is to provide in a high frequency audible alarm device a method and means for reducing the frequency of the audible signal without changing the packaging of the alarm device.

Other objects and advantages of the present invention will be apparent from the following detailed description of a preferred embodiment thereof, which description should be considered in conjunction with the accompanying drawings in which:

DESCRIPTION OF THE PREFERRED EMBODIMENT

Figure 1:
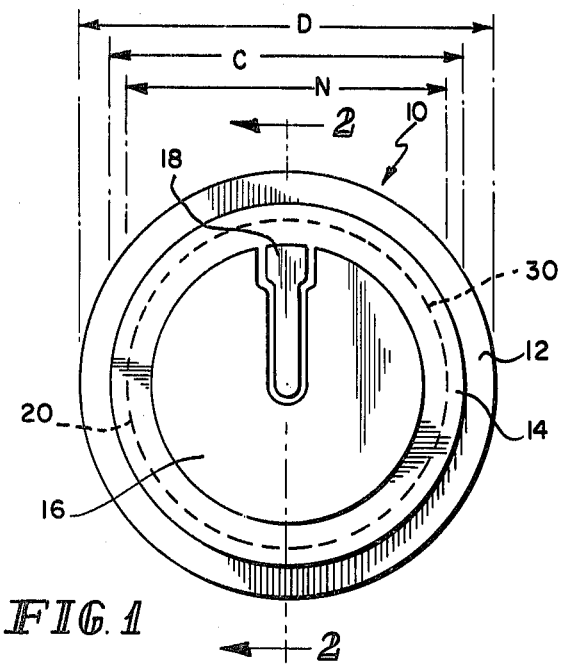
FIG. 1 is a top view of a conventional three electrode piezoelectric transducer.
Figure 2:
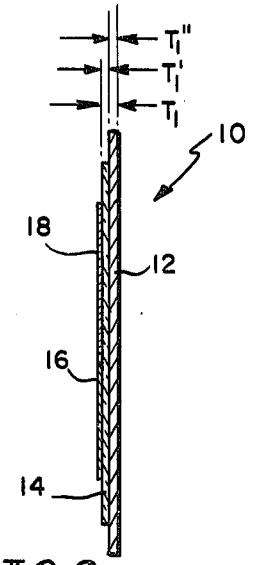
FIG. 2 PRIOR ART
FIG. 2 is a cross section of the conventional piezoelectric transducer shown in FIG. 1 taken along the lines 2—2 of FIG. 1.

Referring now to the drawings and more particularly to FIGS. 1 and 2 there is shown a typical prior art piezoelectric transducer 10. Piezoelectric transducer 10 includes a circular piezoelectric ceramic element 14 having a predetermined diameter C and thickness $T_1'$ mechanically and electrically coupled to a circular brass substrate 12 having a predetermined diameter D and thickness $T_1''$, an electrode 16, an electrode 18, and an electrode not shown which is disposed between the substrate 12 and the piezoelectric ceramic element 14. Electrodes 16, 18 and the electrode not shown include a thin sheet or coating of electrically conductive material, such as silver. Although the piezoelectric transducer 10 shown in FIGS. 1 and 2 includes three electrodes 16, 18, and the electrode not shown, it is not critical to the present invention that the conventional transducer 10 include three electrodes and therefore the three electrode configuration as shown in FIGS. 1 and 2 is illustrative only and not intended to limit the type of conventional transducer for which the present invention is adaptable.

Typically, the conventional piezoelectric transducer 10 shown in FIGS. 1 and 2 has been driven so as to produce an audible frequency substantially equal to the fundamental resonant frequency of the transducer 10. The desired audible frequency and therefore the fundamental resonant frequency of the transducer has been about 3.0 KHZ. In order to produce a piezoelectric transducer 10 having a fundamental resonant frequency of substantially 3.0 KHZ, predetermined dimensions have been set for the transducer 10 which are typically as follows:

brass substrate 12 diameter D=1.375 inches
brass substrate 12 thickness $T_1''$=0.010 inches
ceramic element 14 diameter C=1.00 inches
ceramic element 14 thickness $T_1'$=0.010 inches Accordingly, the total thickness $T_1$ of the brass substrate 12 and the ceramic element 14 of the conventional transducer 10 is typically 0.020 inches. Furthermore, the fundamental nodal diameter N which is substantially determined by the diameter D of the brass substrate 12 is typically about 0.875 inches. Prior art transducers such as the transducer 10 shown in FIGS. 1 and 2 are typically mounted at at least one point on the circumference of a circle 30 having a diameter equal to the fundamental nodal diameter N (nodally mounted). It should be noted that the thicknesses of electrodes 16 and 18, piezoelectric ceramic element 14, and brass substrate 12 relative to the other dimensions of the piezoelectric transducer 10 have been greatly exaggerated in FIG. 2 for purposes of clarity.

Figure 3:
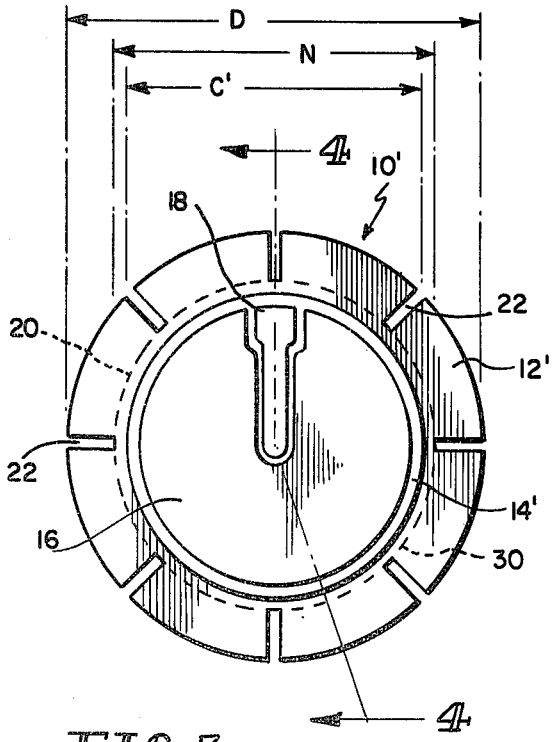
FIG. 3 is a top view of a piezoelectric transducer fabricated in accordance with a preferred embodiment of the present invention.
Figure 4:
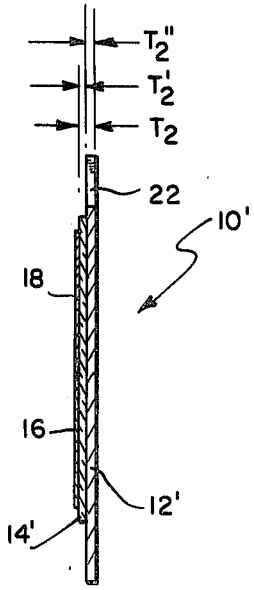
FIG. 4 is a cross section of the piezoelectric transducer shown in FIG. 3 taken along the lines 4—4 of FIG. 3.

Referring now to FIGS. 3 and 4, there is shown a method and means for reducing the fundamental resonant frequency of the conventional piezoelectric transducer 10 shown in FIG. 1 to a frequency of substantially 2.0 KHZ while maintaining the fundamental nodal diameter N and substrate diameter D of the prior art transducer 10 so that a low frequency (2.0 KHZ) audible alarm device can be produced utilizing the same packaging or housing means as a high frequency (3.0 KHZ) audible alarm device. As illustrated in FIG. 3 a piezoelectric transducer 10' having a resonant frequency of substantially 2.0 KHZ includes a circular piezoelectric ceramic element 14' having a diameter C' which is less than the predetermined diameter C and a thickness $T_2'$ which is less than the predetermined thickness $T_1'$ of the 3.0 KHZ transducer 10 (FIG. 1), a circular brass substrate 12' to which the ceramic element 14' is mechanically and electrically coupled having a diameter D which is equal to the predetermined diameter D and a thickness $T_2''$ which is less than the predetermined thickness $T_1''$ of the 3.0 KHZ transducer 10 (FIG. 1), an electrode 16, an electrode 18, and an electrode not shown each of which are similarly situated on the substrate 12' and the ceramic element 14' as previously described in the prior art. Since the thicknesses $T_2'$ and $T_2''$ for the ceramic element 14' and the substrate 12' respectively are less than the thicknesses $T_1'$ and $T_1''$ for the ceramic element 14 and the substrate 12 respectively of the prior art 3.0 KHZ transducer 10 it naturally follows that the total thickness $T_2$ of the 2.0 KHZ transducer 10' (FIG. 4) will be less than the total thickness $T_1$ of the 3.0 KHZ transducer 10 (FIG. 2). Further included in the substantially 2.0 KHZ piezoelectric transducer 10' are eight (8) slots 22 each cut radially and symmetrically in the brass substrate 12' and extended to at least the circle 30 having a diameter equal to the fundamental nodal diameter N. As shown in FIG. 3 the slots 22 are cut radially from the circumference or edge of the circular substrate 12' and extended toward the center of the circular substrate 12' to at least circle 30. Again, the three electrode configuration is only exemplary and is not intended to limit the present invention to its application to a transducer having three electrodes. It should also be noted that the nodal diameter N of piezoelectric transducer 10' is the same as the fundamental nodal diameter N of the prior art piezoelectric transducer 10 (FIG. 1) and that the thicknesses of electrodes 16 and 18, piezoelectric ceramic element 14', and brass substrate 12' relative to the other dimensions of the piezoelectric transducer 10' have been greatly exaggerated in FIG. 4 for purposes of clarity.

Accordingly, the objective of reducing the resonant frequency of a 3.0 KHZ conventional piezoelectric transducer 10 to a resonant frequency of substantially 2.0 KHZ while maintaining the fundamental nodal diameter N and substrate diameter D of the conventional piezoelectric transducer 10 has been attained.

It is well known to those skilled in the art that the dimensional and material factors which determine the resonant frequency of a free circular disk are contained in the equation:

$$f_r = \frac{.412t}{r^2}\sqrt{\frac{Q}{\rho(1-\sigma^2)}}$$

where $f_r$ = resonant frequency
$t$ = thickness of the circular disk
$r$ = radius of the circular disk
$Q$ = Young's modulus of elasticity
$\rho$ = density of the material comprising the circular disk
$\sigma$ = Poisson's Ratio Accordingly, the most effective means to reduce the resonant frequency ($f_r$) would seem to be to alter the radius (r) of the disk. However, a change in the radius of the brass substrate 12 of transducer 10 (FIG. 1) would result in a corresponding change in the fundamental nodal diameter N. Therefore, although the resonant frequency would be reduced by a change in the radius (r) of the brass substrate 12, the objective of maintaining the same fundamental nodal diameter N and predetermined diameter D of the substrate 12 would not be achieved.

Pursuant to the above equation, a further means for attaining the desired objective would appear to be to change the material composition of either the substrate 12, piezoelectric element 14, or both. However, we discovered that the density ($\rho$) and elasticity (Q) of materials as economical to use as brass and ceramic were not sufficiently different to warrant material changes. Seemingly, the only variable in the above equation left to be altered in order to achieve the objective would be the thickness (t) of the materials comprising the circular disk.

Since the conventional piezoelectric transducer 10 (shown in FIG. 1) is a composite of two circular disks (substrate 12 and ceramic element 14) of different diameters, it is not obvious that the calculation of the resonant frequency of the piezoelectric transducer 10 by the above equation would be valid. However, empirically it was found that the resonant frequency of the conventional transducer 10 approximates the $1/r^2$ relationship provided by the above equation when the thicknesses $T_1'$ and $T_1''$ of the ceramic element 14 and the brass substrate 12 respectively are substantially the same.

Accordingly, it being an objective to reduce the resonant frequency of a conventional 3.0 KHZ ($f_{r1}$) transducer to, for example, 1.9 KHZ ($f_{r2}$), and seemingly, the reduction of the total thickness $T_1$ of transducer 10 being the only method available, utilizing the aforementioned equation it was determined by the relationship:

$$f_{r2} = f_{r1}\left(\frac{T_2}{T_1}\right) \text{or}$$

$$T_2 = \left(\frac{f_{r2}}{f_{r1}}\right)T_1$$

that in order to achieve this objective, the total thickness $T_2$ of piezoelectric transducer 10' should be substantially 0.012 inches. This would indicate a thickness $T_2'$ for the ceramic element 14' of substantially 0.006 inches and a thickness $T_2''$ for the brass substrate 12' of substantially 0.006 inches. No special problems are presented with reducing the thickness of the brass substrate 12' to substantially 0.006 inches from the 0.010 inch thickness of the conventional transducer 10; however, because of some manufacturing methods, it becomes uneconomical to reduce the thickness of the ceramic element 14' to dimensions less than 0.008 inches. Accordingly, utilizing 0.008 inches for the thicknesses $T_2'$ and $T_2''$ of the ceramic element 14' and the brass substrate 12' respectively and further utilizing the relationship:

$$f_{r2} = f_{r1}\left(\frac{T_2}{T_1}\right)$$

derived from the equation:

$$f_r = \frac{.412t}{r^2}\sqrt{\frac{Q}{\rho(1-\sigma^2)}}$$

the resonant frequency of a 3.0 KHZ conventional transducer 10 may be economically reduced to substantially 2.4 KHZ by reducing the thicknesses of the ceramic element 14 and the brass substrate 12. As shown, economically reducing the thicknesses of the ceramic element 14 and the brass substrate 12 would not attain the desired objective of a transducer 10 having a resonant frequency of substantially 2.0 KHZ.

Utilizing the general vibrational equation:

$$f_r = \frac{1}{2\pi\sqrt{mc}}$$

where:

-continued $f_r$ = resonant frequency
$m$ = mass of the vibrating material
$c$ = compliance of the vibrating material it was determined that the resonant frequency of the transducer 10 could be reduced if the compliance (c) of the portion of the brass substrate 12 which extends beyond the predetermined diameter C of the piezoelectric ceramic element 14 could be increased without significantly changing the mass (m) of the transducer 10. A method and means for accomplishing an increase in the compliance (c) of the brass substrate 12 without significantly altering the total mass (m) of transducer 10 was found to include the step of radially slotting the brass substrate 12 from the edge of the substrate to at least the circle 30 having a diameter equal to the fundamental nodal diameter N. A series of experiments were conducted to determine the number of slots 22 and whether the slots 22 should be extended to the ceramic element 14 predetermined diameter C or to the fundamental nodal diameter N of the substantially 3.0 KHZ transducer 10 and the following data was collected:

| Number of Slots 22 | $f_r$ | % Δ $f_r$ (Percentage of Change in $f_r$) |
|---|---|---|
| 0 slots | 2.894 KHZ | — |
| 6 slots to ceramic element 14 predetermined diameter C | 2.768 KH | 4.35% |
| 6 slots to fundamental nodal diameter N | 2.631 KHZ | 9.08% |
| 0 slots | 2.960 KHZ | — |
| 8 slots to ceramic element 14 predetermined diameter C | 2.798 KHZ | 5.47% |
| 8 slots to fundamental nodal diameter N | 2.640 KHZ | 10.8% |

Accordingly, it was concluded that radially slotting the extended portion of the brass substrate 12 does reduce the resonant frequency of the transducer 10 without significantly changing the impedance characteristics of the transducer 10. Furthermore, radially slotting the brass substrate 12 to circle 30 having a diameter equal to the fundamental nodal diameter N of the transducer 10 resulted in substantially twice the percentage of change in resonant frequency ($f_r$) as slotting to the predetermined diameter C of the ceramic element 14 and the percentage of change was found to be greater when eight (8) slots 22 (FIG. 3) were cut in the brass substrate 12 than when six (6) slots 22 were used. Further tests were conducted to determine whether segmenting the substrate 12' by using slots provided any advantage over segmenting the substrate 12' by any other means, e.g. triangles, circles, etc. No difference was found to exist between using one means of segmenting verses another; accordingly, it is not intended that the present invention be limited to slots as means for segmenting the substrate 12'.

Utilizing eight (8) slots 22; each symmetrically and radially cut in the brass substrate 12' from its edge to a depth no less than circle 30 having a diameter equal to the fundamental nodal diameter N and applying the 10.8% change in resonant frequency ($f_r$) resulting therefrom to the 2.4 resonant frequency ($f_r$) attained by reducing the brass substrate 12' thickness $T_2''$ and the ceramic element 14' thickness $T_2'$ each to substantially 0.008 inches resulted in a resonant frequency ($f_r$) for transducer 10' of substantially 2.136 KHZ which is very close to the objective of a substantially 2.0 KHZ transducer 10'. In order to facilitate manufacturing of the substantially 2.0 KHZ transducer 10' the predetermined ceramic diameter C (FIG. 1) was reduced to a diameter C' which is less than the fundamental nodal diameter N to prevent the adhesive (not shown) used to attach the ceramic element 14' to the brass substrate 12' from partially filling the slots 22. It was discovered that the reduction of the ceramic element 14 predetermined diameter C (FIG. 1) to a dimension of C' further reduced the resonant frequency ($f_r$) of transducer 10'; however, decreasing the ceramic element 14 diameter C also results in an increase in the impedance of the transducer 10'. Accordingly, the ceramic element 14 diameter C should be reduced primarily for manufacturing purposes and not as a means for reducing the resonant frequency ($f_r$) of the transducer 10'.

In view of the above, it can be seen that the several objects of the invention ar achieved and other advantageous results attained and that further modifications can be made without departing from the spirit and scope of the invention as defined in the appended claims.

What we claim is:

1. A method of reducing the resonant frequency of a piezoelectric audio transducer of the type which includes a substrate and a piezoelectric element coupled to said substrate operating in a flexural mode of vibration which comprises the step of radially slotting said substrate to at least points on said substrate which are substantially free from vibrating motion when said transducer is driven at said resonant frequency whereby the compliance of said substrate is increased without significantly changing the mass of said transducer.

2. In a method of reducing the resonant frequency of a piezoelectric audio transducer without altering the predetermined dimensions of said transducer wherein said transducer includes a substrate, a predetermined nodal point location on said substrate, and a piezoelectric element coupled to said substrate operating in a flexural mode of vibration, the improvement which comprises the step of segmenting said substrate to reduce the resonant frequency while maintaining said predetermined nodal point location on said substrate.

3. The improved method as recited in claim 2 wherein said step of segmenting said substrate is accomplished by radially cutting at least one slot in said substrate.

4. A method of reducing the resonant frequency of a piezoelectric audio transducer while maintaining a predetermined nodal point location wherein said transducer includes a substrate and a piezoelectric element coupled to said substrate operating in a flexural mode of vibration and said predetermined nodal point is located on said substrate, said method comprising the step of radially slotting said substrate whereby said substrate is segmented.

5. The method as recited in claim 4 wherein said slotting extends radially to at least said predetermined nodal point location on said substrate.

6. A method of reducing a substantially 3.0 KHZ resonant frequency of a circular disk piezoelectric audio transducer to a substantially 2.0 KHZ resonant frequency while maintaining a predetermined nodal point location and a predetermined overall transducer diameter wherein said transducer includes a circular disk substrate having a predetermined diameter and thickness and a circular disk piezoelectric element having a predetermined diameter and thickness coupled to said substrate operating in a flexural mode of vibration, said method comprising the step of segmenting said substrate.

7. The method as recited in claim 6 further comprising the steps of reducing said predetermined thicknesses of said substrate and said piezoelectric element.

8. The method as recited in claim 7 wherein said step of segmenting said substrate is accomplished by radially cutting at least one slot in said substrate.

9. The method as recited in claim 8 wherein said slot extends radially to at least said predetermined nodal point location on said substrate.

10. The method as recited in claim 9 wherein eight (8) slots are each symmetrically cut in said substrate from its circumference to at least said predetermined nodal point location.

11. In a piezoelectric audio transducer of the type which includes a substrate and a piezoelectric element coupled to said substrate operating in a flexural mode of vibration for producing an audible signal, said transducer having a fundamental resonant frequency and at least one point located on said substrate which is substantially free from vibratory motion when said transducer is driven at said fundamental resonant frequency, the improvement which comprises: means for reducing said fundamental resonant frequency to a substantially lower resonant frequency without relocating said point which is substantially free from vibratory motion, said means for reducing said fundamental resonant frequency including at least one slot radially cut in said substrate.

12. The improved piezoelectric transducer as recited in claim 11 wherein said slot is radially cut to at least said point which is substantially free from vibratory motion.

13. A piezoelectric audio transducer having a resonant frequency of substantially 2 KHZ and operating in a flexural mode of vibration to produce an audible signal at said resonant frequency comprising: a substrate having at least one point located thereon which is substantially free from vibrating motion when said transducer is driven at said resonant frequency, means provided in said substrate for segmenting said substrate, said segmenting means radially provided to a depth no less than to said point on said substrate which is substantially free from vibrating motion, a piezoelectric element coupled to said substrate, and at least two electrodes electrically coupled to said piezoelectric element.

14. The piezoelectric transducer as recited in claim 13 wherein said substrate is brass and is a circular disk.

15. The piezoelectric transducer as recited in claim 14 wherein said piezoelectric element is ceramic and is a circular disk.

16. The piezoelectric transducer as recited in claim 15 wherein said substrate is segmented by eight (8) slots each symmetrically cut in said substrate from its circumference to at least said point on said circle which is substantially free from vibratory motion.

17. The piezoelectric transducer as recited in claim 16 wherein said circular brass substrate has a diameter of substantially 1.375 inches.

18. The piezoelectric transducer as recited in claim 17 wherein said circular brass substrate has a thickness of substantially 0.008 inches, said circle on said substrate has a diameter of substantially 0.875 inches, and said circular ceramic piezoelectric element has a thickness of substantially 0.008 inches and a diameter less than said diameter of said circle on substrate.

19. In an audible alarm device which includes means for housing a piezoelectric transducer having a circular substrate with a predetermined diameter, a circular piezoelectric element coupled to said substrate, a fundamental resonant frequency and a fundamental nodal diameter wherein said transducer is mechanically coupled to said housing means at at least one point on a circle having a diameter equal to said fundamental nodal diameter, the improvement which comprises: means for reducing said fundamental resonant frequency of said transducer to a substantially lower resonant frequency without necessitating a change in said means for housing said transducer, said frequency reducing means including at least one slot radially cut in said circular substrate to at least said fundamental nodal diameter.

* * * * *